United States Patent [19]

Stull

[11] Patent Number: 4,570,825

[45] Date of Patent: Feb. 18, 1986

[54] TAMPER-EVIDENT CAP CONSTRUCTION

[76] Inventor: Gene Stull, 5 Oak St., Chester, N.J. 07930

[21] Appl. No.: 629,505

[22] Filed: Jul. 10, 1984

[51] Int. Cl.[4] ..... B67D 5/22; B65D 47/10

[52] U.S. Cl. ..... 222/45; 222/153; 222/521; 222/529; 222/541; 215/253

[58] Field of Search ..... 222/521, 541, 528, 529, 222/153, 23, 41, 45; 215/250, 251, 253

[56] References Cited

U.S. PATENT DOCUMENTS

| | | | |
|---|---|---|---|
| 2,066,889 | 1/1937 | Kay | 222/153 |
| 2,213,932 | 9/1940 | Rehfeld | 215/250 |
| 3,259,233 | 7/1966 | Beeman | 222/541 |
| 3,604,596 | 9/1971 | Khoury et al. | 222/153 |
| 4,438,870 | 3/1984 | Stull | 222/521 |

FOREIGN PATENT DOCUMENTS

| | | | |
|---|---|---|---|
| 1122393 | 1/1962 | Fed. Rep. of Germany | 222/153 |

*Primary Examiner*—Joseph J. Rolla
*Assistant Examiner*—Andrew Jones
*Attorney, Agent, or Firm*—H. Gibner Lehmann; K. Gibner Lehmann

[57] ABSTRACT

A tamper-evident cap construction for a dispenser, comprising a cap body having a discharge opening, a screw cap carried thereon and adapted to close off the discharge opening, and a frangible tab that is integral with the screw cap and which extends outwardly over an exposed exterior surface of the body and is integral therewith by virtue of a common fused juncture area at the surface. Preferably the fusing takes the form of a sonic weld. The tab has a transverse line of weakness which can be adjacent to either the point of attachment of the tab to the screw cap, or else to the fused area. The tab normally prevents relative turning between the screw cap and the cap body, but can rupture when a turning force is applied therebetween, having a magnitude which is less that required to separate the tab from the body at the location of the fused juncture. Rupturing of the tab thus provides an indication to the consumer that possible tampering with the container has occurred, since the remaining broken ends of the tab are then readily visible.

12 Claims, 7 Drawing Figures

TAMPER-EVIDENT CAP CONSTRUCTION

BACKGROUND

This invention relates generally to tamper-evident closures for containers, and more particularly to closure constructions of the type which employ breakable strips or lugs which are intended to rupture in the event that the container is tampered with, prior to purchase or initial use by the consumer.

Various arrangements have been proposed and produced, for indicating that a particular container may have been tampered with.

U.S. Pat. No. 3,455,478 illustrates one approach, which is typical of that employed by a number of others, namely providing a closure cap with a collar that is connected to the cap by thin, frangible webs or bridges which are intended to break upon removal of the cap. In this patented construction, the collar has an internal bead which, during assembly, is forced over a cooperable external bead on the neck of the container. The collar is thus permanently retained on the container even after the cap is removed by the consumer.

A somewhat similar arrangement is shown in U.S. Pat. No. 3,673,761, except in this latter device, instead of employing a fixed internal bead on the collar, following installation of the cap and collar, the lower edge portion of the latter is heated and thereafter rolled over an external bead on the container neck.

Many of the dispensers in use today involve two-part caps, one part normally referred to as a base cap part or cap body, and being adapted to be permanently retained on the neck of the container, and the other part, commonly known as the screw cap part, being capable of being unscrewed from the base cap part or cap body. The necessity for employing this type of construction is that it is often difficult to mold a container with a relatively complex neck configuration of a type that could accept certain screw caps directly. As a result, the neck of the container is provided with a relatively simple configuration, such as a retention bead, which can cooperate with a mating retention structure on the base cap part or cap body. The arrangement between the base cap part and the container is usually such that a strong and permanent retention is had. This is usually accomplished by providing suitable cooperable bead structures as mentioned above, or by screw thread arrangements associated with locking ratchet teeth, etc. In practically all cases, such a construction discourages attempts to remove the base cap part or cap body from the container neck.

Problems have been encountered, however, in providing a container which would indicate tampering involving attempted removal of a screw cap from the base cap or cap body. Since the screw cap and cap body are not capable of being molded as a single piece, especially where screw threads are involved, the use of break-away strips has not, to my knowledge, been successful. The employment of glues or adhesives is considered to be too time consuming and messy, as well as not providing a reliable bond.

SUMMARY

The above disadvantages and drawbacks of prior tamper-evident closure constructions are largely obviated by the present invention, which has for one object the provision of a novel and improved tamper-evident cap construction which is both simple in its structure and reliable in operation.

A related object of the invention is to provide an improved tamper-evident cap construction as above set forth, wherein there is featured a positive indication of tampering or unauthorized use, thereby protecting the consumer against possible harm from tainted food, medicines or other drugs, etc.

Still another object of the invention is to provide an improved tamper-evident cap construction as above characterized, wherein the tamper-indicating means is readily visible from above and from the side of the container, so as to immediately draw the attention of the consumer as he or she is handling the container.

Yet another object of the invention is to provide an improved tamper-evident cap construction of the kind indicated, wherein high-production techniques can be employed so that the overall cost is low, and wherein the additional expense involved with including the tamper-evident feature is minimal.

A still further object of the invention is to provide an improved tamper-evident cap construction as outlined above, wherein the added plastic material involved with including the tamper-evident feature is extremely low, thus keeping the device competitive from the commercial standpoint.

The above objects are accomplished by a tamper-evident cap construction, comprising a cap body having a discharge opening, a screw cap receivable on the cap body for selectively closing off the discharge opening, and a frangible tab integral with the screw cap and having a portion extending past the periphery thereof in overlying relation to an exposed exterior surface of the cap body. The tab ultimately is also integral with the cap body by virtue of a common fused juncture area on the exposed exterior surface so as to resist relative turning between the screw cap and cap body. The tab has a transverse line of weakness which is adapted to rupture when there is applied to the screw cap a turning force having a magnitude which is somewhat less than that required to separate the tab from the cap body at the location of the fused juncture. Rupturing of the tab thus provides to the prospective user an indication of possible tampering.

Other features and advantages will hereinafter appear.

Figure 1:
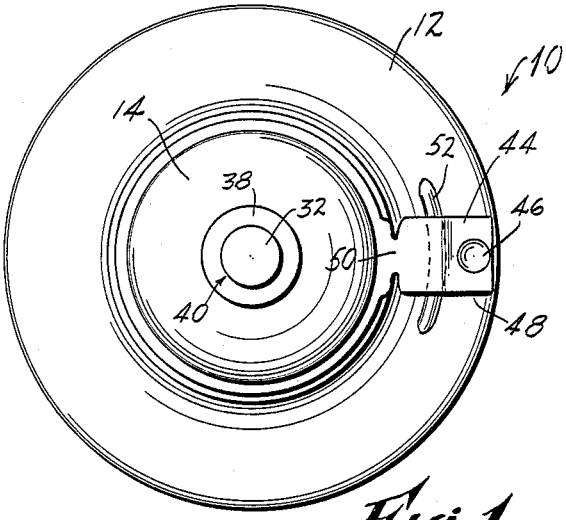
FIG. 1 is a top plan view of the tamper-evident cap construction of the present invention, particularly illustrating the frangible tab assooiated with the cap body and screw cap, and illustrating a line or portion of weakness on the tab, adjacent its point of attachment to the screw cap.

Referring first to FIGS. 1–4 there is illustrated a closure cap construction generally designated by the numeral 10, comprising a base cap or cap body 12 and a screw cap 14. Disposed on the inner surface of the body 12 are two annular rings or retention beads 16, 18 which cooperate with similar structures on the neck of a container (not shown), in order to provide a permanent retention of the part 12 thereon. The beads 16 and 18 also provide a secondary seal between the container and cap body 12. The underside of the body 12 has an annular flange 20 which is receivable in the container neck, and seals thereagainst. Also a depending duct 22 provides communication with the discharge passage or opening 24 of the body 12.

The exterior of the body 12 is provided with threads 26 and also a pair of ramps or cam tracks 28, 30 upon which lugs (not shown) on the underside of the screw cap 14 ride. The arrangement is such that a more positive unscrewing of the screw cap 14 is made possible by the provision of the lugs riding on the cam tracks 28 and 30.

Disposed at the upper portion of the body 12 is a stopper plug 32 of generally cylindrical configuration, supported by two legs 34 and 36.

Referring again to FIG. 2, the screw cap 14 has a generally conical outer surface configuration, and an apertured flat top portion 38 with a dispensing aperture 40 that is normally sealed off by the stopper plug 32 when the parts are in the position illustrated. On the interior wall of the screw cap are threads 42 that engage the threads 26 of the cap body 12. The threads 26 and 42 operate for the most part to urge the screw cap 14 toward its closing position, as shown, whereas the lugs on the underside of the screw cap and the cam tracks 28 and 30 operate to force the screw cap open when it is unscrewed. In the open position the stopper plug 32 is removed from the aperture 40, as can be readily understood.

In accordance with the present invention novel tamper-evident means are provided on the screw cap 14 and cap body 12, for indicating if the part 14 has been disturbed prior to its initial use by the consumer, said means comprising a frangible tab 44 particularly illustrated in FIGS. 1–4, the tab 44 being molded integral with the screw cap 14 and being made integral with the cap body 12 by virtue of a common fused juncture area 46 on the exposed exterior surface 48 of the cap body 12. As illustrated, this exposed surface 48 is somewhat conical in shape, having a slight curvature or concave cross sectional configuration. Also, by the invention the tab 44 has a transverse line or section 50 of weakness and is adapted to tear or rupture along this line when the screw cap 14 is subjected to a predetermined turning force, which force may be less than that which would be required to separate the tab 44 from the fused area 46. As shown, the tab 44 is elongate and extends radially outward past the periphery of the screw cap 14, and the transverse line 50 of weakness is generally perpendicular to the axis of the tab 44.

Figure 3:
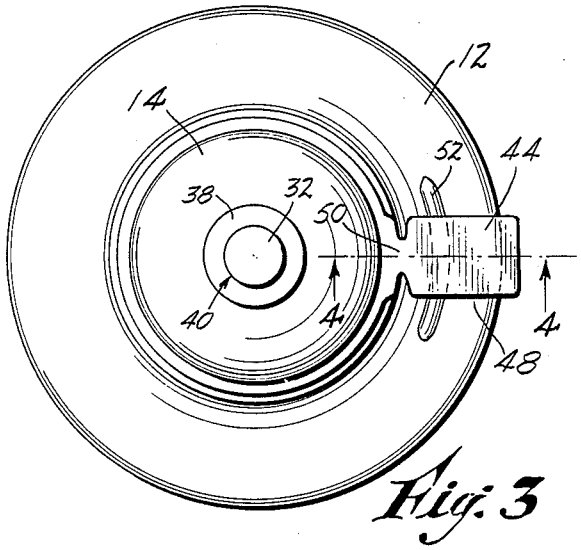
FIG. 3 is a top plan view, similar to FIG. 1, of the screw cap and cap body, and the tab as it would appear just prior to the fusing of the outer end thereof to the exposed exterior surface of the cap body.

FIG. 3 shows the assemblage of cap body 12 and screw cap 14 with the tab 44 prior to the fusing of the latter to the body 12. The fusing preferably takes the form of what is known as a sonic weld, wherein heat is applied to the materials to be fused, by electrical induction. The equipment for accomplishing sonic welding is known, and accordingly it is not illustrated or described.

Further in accordance with the invention there is provided on the exposed exterior surface 48 an upstanding projection 52 that is located beneath the tab 44 and which applies an upward bias thereto at a location adjacent its center. The tab 44 is molded integral with the screw cap 14 and has the configuration of FIG. 4 prior to assembly. Following assembly, the tab 44, being resilient, is stretched over the projection 52 and downwardly onto the periphery of the surface 48, and the sonic welding is then accomplished at location 46. In this manner, there is imparted to the tab 44 a cross-sectional configuration somewhat similar to the capital letter "S".

Figure 2:
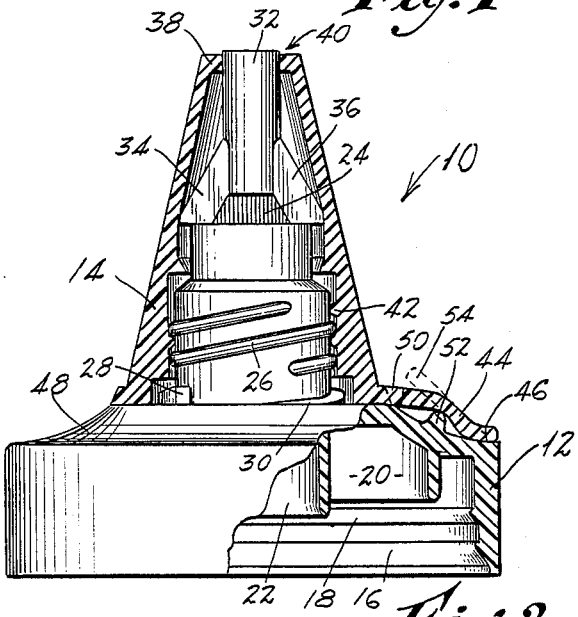
FIG. 2 is a partial vertical section of the cap construction of FIG. 1, showing in dotted outline, a torn end of the tab as it would appear, following rupture.

Upon the occurrence of tampering, or alternately during the initial use of the dispenser, the tab 44 ruptures along the line 50, and the torn end 54, shown dotted in FIG. 2, is propped up by the projection 52, this constituting a pronounced indication of tampering to the consumer, more so than would be the case if the projection 52 were to be omitted.

The particular form of the projection 52 is of no special significance, except that it is preferably located to extend along the area where the tab is ultimately positioned. I have found that by making the projection 52 arcuate, or semi-circular, the desired result is achieved, and there occurs little or no interference with the fusing or welding operation.

Figure 5:
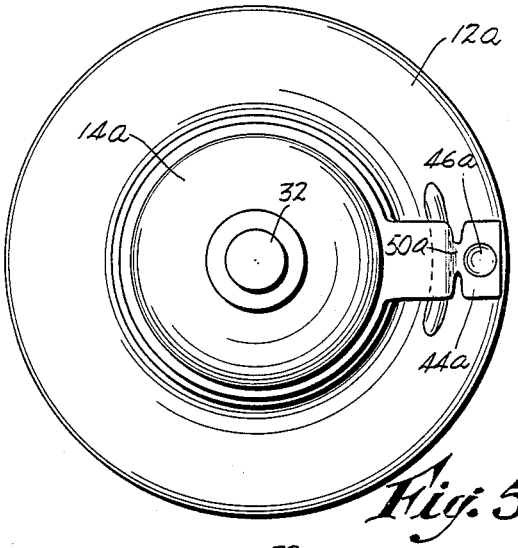
FIG. 5 is a top plan view, similar to FIG. 1, of a modified tamper-evident cap construction, wherein a line of weakness or weak-section on the tab is nearer the point of attachment of the tab to the cap body.
Figure 6:
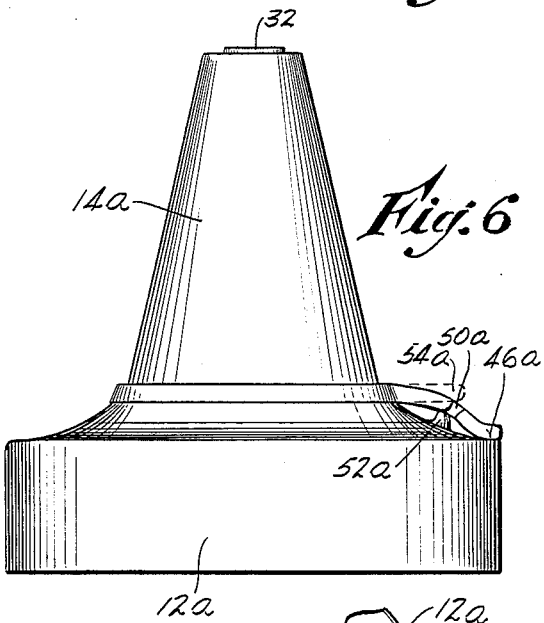
FIG. 6 is a side elevation of the construction of FIG. 5, showing in dotted outline, a torn end of the tab as it would appear, following rupture.
Figure 7:
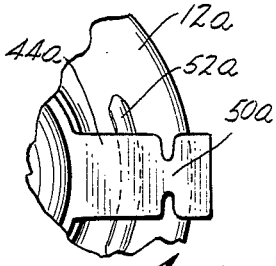
FIG. 7 is a fragmentary top plan view of the construction of FIGS. 5 and 6, showing the tab as it would appear just prior to the fusing of the outer end thereof to the exposed exterior surface of the cap body.

Another embodiment of the invention is shown in FIGS. 5–7, wherein similar reference numerals have been applied to corresponding parts of like construction. The cap body is indicated **12*a*, and the screw cap 14*a*. The tab 44*a* has a modified construction in that the line 50*a* of weakness is disposed nearer the attachment of the tab 44*a* to the cap body 12*a* than its point of attachment to the screw cap 14*a*. The internal structures of the cap body 12*a* and screw cap 14*a*** of these figures are identical to those of the first embodiment.

Figure 4:
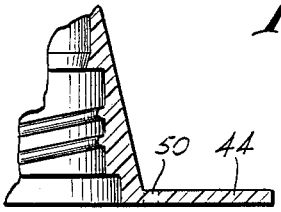
FIG. 4 is a fragmentary section taken on line 4—4 of FIG. 3.

In the present instance, the tab **44*a* would be molded integral with the screw cap 14*a*, and initially would extend straight out from the periphery thereof, as in FIG. 4. During the fusing operation at the surface area 46*a*, the tab 44*a* would again have imparted to it a cross sectional configuration similar to a flattened letter "S", as in FIG. 6. In this figure, there is shown in dotted outline the torn or ruptured end 54*a* of the tab, following initial use of the dispenser. The end 54*a* is again propped up by the projection 52*a* on the surface 46*a*. FIG. 7 illustrates the appearance of the tab 44*a* prior to its being fused to the cap body 12*a***.

From the above it can be seen that I have provided a novel and improved tamper-evident cap construction which is both simple in its structure and reliable in operation. Its simplicity has the advantage that education of the consumer is not required in order for him to understand the tamper-evident feature. Moreover, there is no doubt as to whether or not the tab is intact, because it is prominent from both above and the side of the container.

Due to the small amount of additional material represented by the tab, there is little added expense, as far as extra plastic being required. Moreover, the fusing step can be quickly and economically carried out by production techniques with a minimum of time and effort.

The device is thus seen to represent a distinct advance and improvement in the technology of tamper-indicating closure constructions.

Each and every one of the appended claims defines a distinct aspect of the invention which is separate from all others, and accordingly each claim is to be treated in this manner when examined in the light of the prior art devices in any determination of novelty or validity.

Variations and modifications are possible without departing from the spirit of the claims.

What is claimed is:

1. A tamper-evident cap construction, comprising in combination:

(a) a cap body having a discharge opening, (b) a screw cap adapted to be received on said cap body so as to selectively close off the discharge opening thereof, (c) a frangible resilient tab integral with the screw cap and extending outwardly past the periphery thereof in overlying relation to an exposed exterior surface of the cap body, (d) said tab being integral with the cap body by virtue of a common fused juncture area at the said exposed exterior surface of the body so as to resist relative turning between the screw cap and cap body, (e) said tab having a transverse line of weakness adapted to rupture when a turning force is applied between said screw cap and cap body, (f) said cap body having an upstanding projection underlying the tab and biasing central portions thereof upwardly such that upon rupture of the tab, a torn end thereof will be upwardly displaced by the upstanding projection, thereby to indicate to a potential user that the cap has been tampered with.

2. The invention as defined in claim 1, wherein:

(a) said transverse line of weakness is disposed closer to the screw cap than to the cap body.

3. The invention as defined in claim 1, wherein:

(a) said transverse line of weakness is disposed closer to the cap body than to the screw cap.

4. The invention as defined in claim 1, wherein:

(a) said projection comprises a circumferential ridge on the exposed exterior surface, and extending generally transverse to the axis of the tab.

5. The invention as defined in claim 1, wherein:

(a) said projection is molded integral with the cap body.

6. The invention as defined in claim 1, wherein:

(a) said exposed surface has a generally conical configuration.

7. The invention as defined in claim 1, wherein:

(a) said tab, prior to rupture, has a configuration similar to the capital letter "S".

8. The invention as defined in claim 1, wherein:

(a) the common fused juncture area comprises a sonic weld between one end of the tab and the cap body.

9. The invention as defined in claim 1, wherein:

(a) following rupture, central portions of said tab are propped up.

10. The invention as defined in claim 1, wherein:

(a) said tab extends substantially radially with respect to the screw cap and cap body.

11. The invention as defined in claim 10, wherein:

(a) said tab is elongate, and (b) the line of weakness extends substantially perpendicular to the length of the tab.

12. The invention as defined in claim 1, wherein:

(a) the width of the tab exceeds its thickness.

* * * * *